United States Patent [19]

Bandukwalla

[11] Patent Number: 4,877,369

[45] Date of Patent: Oct. 31, 1989

[54] VANED DIFFUSER CONTROL

[75] Inventor: Phiroze Bandukwalla, Olean, N.Y.

[73] Assignee: Dresser-Rand Company, Corning, N.Y.

[21] Appl. No.: 153,589

[22] Filed: Feb. 8, 1988

[51] Int. Cl.[4] ..... F01D 17/14

[52] U.S. Cl. ..... 415/148; 415/199.2

[58] Field of Search ..... 415/46, 148, 150, 209, 415/210, 211, 199.1, 199.2, 199.3, 158, DIG. 1

[56] References Cited

U.S. PATENT DOCUMENTS

| | | | |
|---|---|---|---|
| 481,074 | 8/1892 | Spencer | 415/158 |
| 1,047,663 | 12/1912 | Lawaczeck | 415/211 |
| 1,604,328 | 10/1926 | Walker | 415/148 |
| 1,723,254 | 8/1929 | Popp | 415/150 |
| 2,739,782 | 3/1956 | White | 415/17 |
| 2,803,396 | 8/1957 | Darrow | 415/DIG. 1 |
| 2,846,185 | 8/1958 | Widmer | 415/150 |
| 2,996,996 | 8/1961 | Jassniker | 415/126 |
| 3,032,259 | 5/1962 | Jassniker | 415/148 |
| 3,079,127 | 2/1963 | Rowlett et al. | 415/48 |
| 3,160,392 | 12/1964 | Hunter | 415/151 |
| 3,289,919 | 12/1966 | Wood | 415/150 |
| 3,362,624 | 1/1968 | Endress | 415/1 |
| 3,365,120 | 1/1968 | Jassniker | 415/26 |
| 3,453,964 | 7/1969 | Hallworth | 415/151 |
| 3,588,270 | 6/1971 | Boelcs | 415/162 |
| 3,667,860 | 6/1972 | Endress et al. | 415/160 |
| 3,781,128 | 12/1973 | Bandukwalla | 415/211 |
| 3,784,318 | 1/1974 | Davis | 415/158 |
| 3,861,826 | 1/1975 | Dean, Jr. | 415/211 |
| 3,972,642 | 8/1976 | Fricke et al. | 415/145 |
| 4,070,132 | 1/1978 | Lynch | 415/48 |
| 4,219,305 | 8/1980 | Mount et al. | 415/13 |
| 4,232,514 | 11/1980 | Flatt | 415/148 |
| 4,257,733 | 3/1981 | Bandukwalla et al. | 415/13 |
| 4,265,589 | 5/1981 | Watson et al. | 415/47 |
| 4,378,194 | 3/1983 | Bandukwalla | 415/49 |
| 4,403,914 | 9/1983 | Rogo et al. | 415/165 |
| 4,416,583 | 11/1983 | Byrns | 415/148 |
| 4,460,310 | 7/1984 | Plunkett | 415/26 |
| 4,470,256 | 9/1984 | Palmer | 415/150 |
| 4,544,325 | 10/1985 | Rogo et al. | 415/150 |

FOREIGN PATENT DOCUMENTS

| | | | |
|---|---|---|---|
| 133613 | 10/1979 | Japan | 415/150 |
| 122203 | 6/1985 | Japan | 415/115 |
| 992829 | 1/1983 | U.S.S.R. | 415/53 R |
| 1250732 | 8/1986 | U.S.S.R. | 415/148 |

OTHER PUBLICATIONS

Abdelhamid, A. N., "Effects of Vaneless Diffuser Geometry on Flow Instability in Centrifugal Compression Systems," The American Society of Mechanical Engineers, Bulletin 81-GT-10, Mar. 1981.

Appendix E, "Advanced Concepts in Turbomachinery," Fluid Dynamics Institute, Aug. 17-21, 1981 Symposium.

Japikse, D., "Dynamic Flow Conditions in Vaneless Diffusers," Turbomachinery Design Digest, Design Data Sheet No. 5, Aug. 1981.

*Primary Examiner*—Robert E. Garrett
*Assistant Examiner*—John T. Kwon

[57] ABSTRACT

An improved diffuser includes a plurality of vanes and an exit type throttle. The vanes maybe high solidity vanes.

9 Claims, 2 Drawing Sheets

VANED DIFFUSER CONTROL

FIELD OF THE INVENTION

This invention pertains to improvements in vaned diffusers, and more particularly to a variable constriction or throttle at the exit of a vaned diffuser.

BACKGROUND OF THE INVENTION

Amr Abdelhamid demonstrated at least as early as 1981 that throttling the diffuser exit can change flow angle in a vaneless diffuser. See, Advanced Concepts in Turbomachinery, August 1981, Fluid Dynamics Institute, Hanover, N.H. It has also been shown that throttling the diffuser inlet could have performance benefits. Inlet throttling in a vaned diffuser is shown in U.S. Pat. No. 4,378,194 issued Mar. 29, 1983 to Bandukwalla. Throttling the entire diffuser passage through a slotted wall is shown, for example, in U.S. Pat. No. 4,403,914 issued Sept. 13, 1983 to Rogo et al. However these prior art devices are characterized by certain shortcomings. Inlet throttling where the flow has a high mach number causes sudden expansion loss, turbulence and high friction losses. Slotted wall designs are costly, complex and subject to leakage losses. The throttled exit vaneless design is mechanically simple but not efficient.

SUMMARY OF THE INVENTION

The deficiencies of prior art diffusers are remedied by the invention disclosed herein. Accordingly, a diffuser is provided having high solidity vanes. A throttle is located at the diffuser exit. The throttle may be in the form of one or more expanding rings, an iris-like variable aperture or an inflatable valve.

DESCRIPTION OF THE PREFERRED EMBODIMENT

Figure 1:
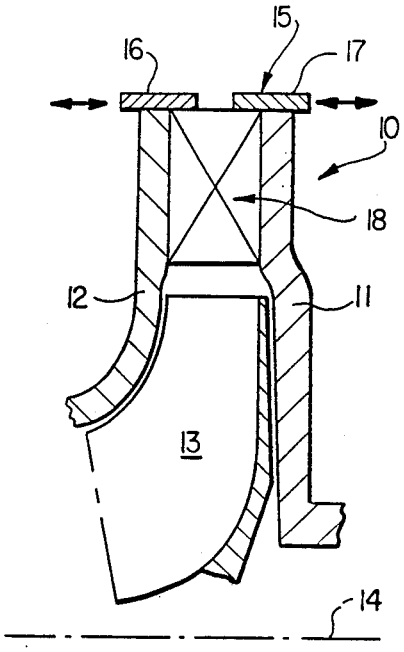
FIG. 1 shows in schematic cross section the diffuser control of the present invention, as applied to a centrifugal compressor.

As shown in FIG. 1, a centrifugal compressor incorporating the improvements of the present invention includes a diffuser 10 having a hub wall 11 and a shroud wall 12. An impeller 13 revolves about a central axis 14, diverting compressed fluid into the diffuser 10. The diffuser includes a sliding exit throttle 15 which is composed of two axially sliding cylindrical throttle rings 16, 17. The example of FIG. 1 is shown as having a hub-side throttle ring 17 and a shroud-side throttle ring 16, although it will be understood that either ring alone may be used without the other. Unlike any known prior art design, the improved diffuser includes a plurality of vanes 18. The preferred vane in this application is a high solidity wedge type vane which will yield maximum efficiency, range having been provided by the throttle device 16, 17. It will be understood that low solidity vanes will work, as will aerodynamic vanes.

Figure 2:
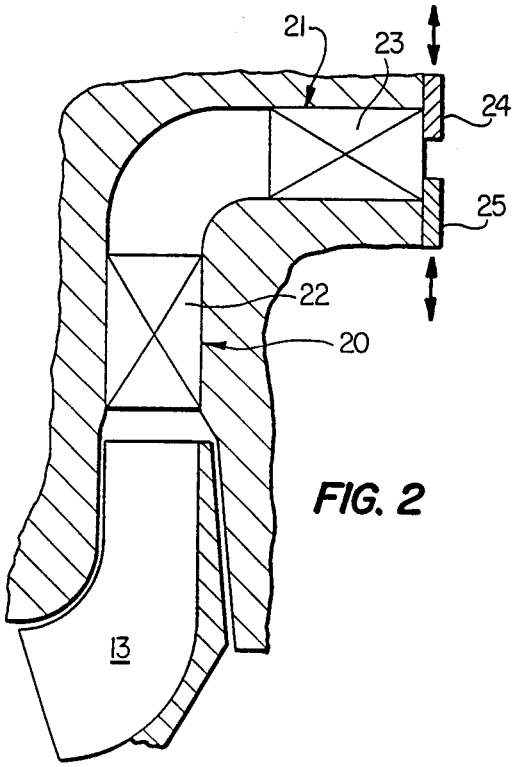
FIG. 2 shows in schematic cross section the diffuser control of the present invention as applied to a centrifugal compressor having axially directed flow.

FIG. 2 shows the present invention as applied to an centrifugal compressor with a radial diffuser 20 followed by an axial diffuser 21. Vane selection as to radial vanes 22 and axial vanes 23 is the same as discussed with reference to the example of FIG. 1. In this example, iris-type throttles 24, 25 are substituted for sliding cylinders 15, 16.

Figure 3:
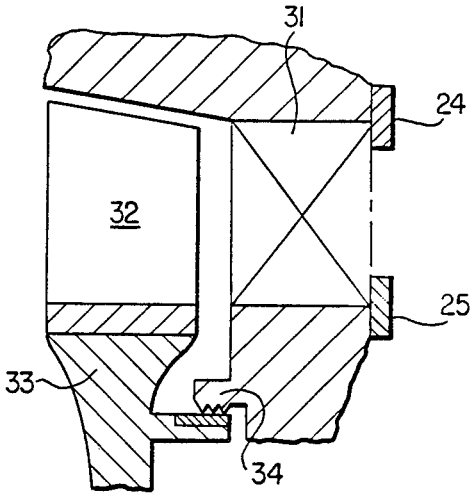
FIG. 3 shows in schematic cross section the diffuser control of the present invention as applied to an axial compressor.

FIG. 3 illustrates the inventive combination of diffuser vanes 31 and iris-type throttles as applied to an axial compressor. The axial compressor includes axial rotor blades mounted on a rotor disc 33 and includes knife seals 34.

Figure 4:
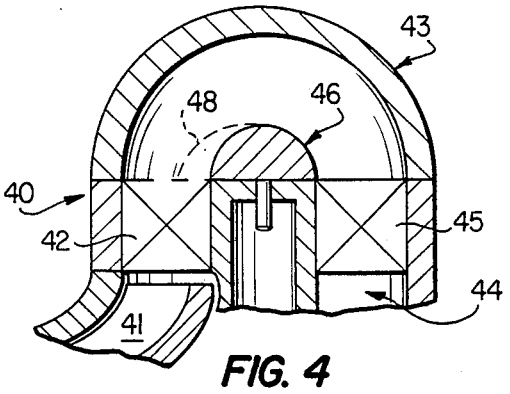
FIG. 4 shows in cross section the diffuser control of the present invention as applied to a multistage centrifugal compressor with return channels. In this figure a unidirectional expandable restriction is employed.
Figure 5:
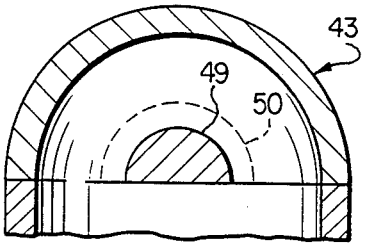
FIG. 5 shows in cross section the diffuser control of the present invention as applied to a multistage centrifugal compressor with return channels. In this figure a uniformly expandable restriction is employed.

FIG. 4 is an illustration of how the invention may be applied to a multi-stage centrifugal compressor 40. The multi-stage centrifugal compressor includes an impeller 41, a first vaned diffuser 42, an 180 degree or U-bend 43 and a return channel 44, which also includes vanes 45. Exit throttling in this type of application is accomplished with an inflatable bladder-like valve 46. The inflatable valve is expanded with oil or air from a nipple 47. In the resting position the valve 46 assumes a roughly semi-circular form. In an activated position, the valve expands to partially occlude the first diffuser exit as shown by the dotted lines 48. The expansion is variable. A variant of the inflatable valve 46 is shown in FIG. 5, wherein a uniformly expansible valve 49, when activated variably occludes the entire U-bend 43 in a concentric fashion as shown by the dotted lines 50.

While we have described the present invention in association with specific equipment it is to be understood that this description is made by way of example and not as a limitation to the accompanying claims.

What is claimed is:

1. In a compressor diffuser having an inlet, an annular outlet, a passageway between said inlet and said annular outlet for the flow of compressed fluid therethrough, and a plurality of vanes formed in said passageway, the improvement comprising an annular restriction downstream of, adjacent to and cooperating with the annular outlet, wherein the restriction defines an annular exit opening for compressed fluid exiting said diffuser, the width of which annular opening can be varied by movement of said restriction transverse to said annular opening.

2. The improved diffuser of claim 1, wherein the vanes are high solidity vanes.

3. The improved diffuser of claim 1 or 2, wherein the restriction comprises a first axially slidable ring.

4. The improved diffuser of claim 1 or 2, wherein the restriction further comprises a second axially slidable ring.

5. The improved diffuser of claim 1 or 2, wherein the restriction comprises a first adjustable iris member.

6. The improved diffuser of claim 5, wherein the restriction comprises a second adjustable iris member radially inward of the first iris member.

7. In a diffuser having a plurality of vanes formed therein an inlet and an outlet, the improvement comprising:

a restriction adjacent to and cooperating with the outlet, wherein the restriction defines an opening of variable size;

the restriction comprising an inflatable bladder-like valve located within an 180 degree bend.

8. The improved diffuser of claim 7, wherein the valve expands non-uniformly.

9. The improved diffuser of claim 7, wherein the valve expands uniformly.

* * * * *